US006489581B2

(12) United States Patent
Ozil et al.

(10) Patent No.: US 6,489,581 B2
(45) Date of Patent: Dec. 3, 2002

(54) ARC-BLASTING SWITCH POSSESSING A BREAK CHAMBER WITH LOW GAS COMPRESSION AND RECIPROCATING PISTON MOVEMENT

(75) Inventors: Joel Ozil, Lyons (FR); Michel Perret, Bourgoin-Jallieu (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/828,872

(22) Filed: Apr. 10, 2001

(65) Prior Publication Data

US 2001/0035396 A1 Nov. 1, 2001

(30) Foreign Application Priority Data

Apr. 18, 2000 (FR) ..... 00 04987

(51) Int. Cl.[7] ..... H01H 33/88
(52) U.S. Cl. ..... 218/61; 218/43; 218/60
(58) Field of Search ..... 218/43, 45, 46–54, 218/57, 66, 59–63

(56) References Cited

U.S. PATENT DOCUMENTS 3,331,935 A 7/1967 Milianowicz
5,293,014 A * 3/1994 Perret ..... 218/57
5,723,840 A * 3/1998 Bojic et al. ..... 218/60
6,018,133 A * 1/2000 Thuries ..... 218/43

FOREIGN PATENT DOCUMENTS

| | | | |
|---|---|---|---|
| DE | 39 30 548 | 3/1991 | ..... H01H/33/915 |
| EP | 0 540 971 | 5/1993 | ..... H01H/33/91 |
| EP | 0 895 262 | 2/1999 | ..... H01H/33/90 |
| FR | 2 753 564 | 3/1998 | ..... H01H/33/915 |

OTHER PUBLICATIONS

European Search Report dated Jan. 3, 2001.

* cited by examiner

*Primary Examiner*—Lincoln Donovan
*Assistant Examiner*—M. Fishman
(74) *Attorney, Agent, or Firm*—Sughrue Mion, PLLC

(57) ABSTRACT

The arc blast switch can have single or dual contact movement and possesses a break chamber with low gas compression, the switch includes a first contact and a second contact, the first contact being movable in a longitudinal axis and being secured to the break chamber in which the gas is compressed by a piston. A device for displacing the piston is arranged so that its movement changes direction inside the case of the switch after the gas compression stage, and the device includes a telescopic link connected to the piston. The length of the displacement of the piston inside the case during the compression stage is not less than the length of the displacement of the first contact during the compression stage.

14 Claims, 4 Drawing Sheets

ARC-BLASTING SWITCH POSSESSING A BREAK CHAMBER WITH LOW GAS COMPRESSION AND RECIPROCATING PISTON MOVEMENT

The invention relates in general to a switch, and more particularly to a circuit breaker, possessing a break chamber with low gas compression. The invention can apply equally well to single contact movement circuit breakers and to dual contact movement circuit breakers. In particular, the way in which dual contact movement circuit breakers operate and the way in which low gas compression circuit breakers operate have both been known separately for many years, however combining them presents drawbacks that are explained below. For low gas compression circuit breakers, reference can be made in particular to French patent FR 2 696 274.

BACKGROUND OF THE INVENTION

It is appropriate to recall that the principle of low compression means that gas is compressed in the break chamber only during part of the stroke of the contacts, and generally during less than 50% thereof. This first portion of circuit breaker opening corresponds to the contacts moving from the closed position to the beginning of blasting the arc that follows separation of the contacts. Gas compression is at its maximum at the moment the contacts separate, and the pressure falls quickly as the arc is blasted. The amount of energy required for opening the circuit breaker is thus reduced during the second portion of the stroke of the contacts.

The principle of dual contact movement has been applied for a long time (see French patent FR 2 491 675), since it consists merely in driving both contacts simultaneously in opposite directions, either at different speeds or at speeds that are equal, thereby providing displacement that is symmetrical about the closed position. Drive can be provided by a linkage or by a rack-and-pinion system. Compared with a single movement device, the advantage of a dual movement device is that it enables the time required for separating the contacts to be reduced without increasing moving contact speed. The time required to separate the contacts depends on their mean relative speed and on their overlap distance R. Thus, for a symmetrical dual movement device, the contact separation time is approximately halved compared with a single movement device, for identical overlap distance R and mean contact speed. In addition, on separation of the contacts, each contact has moved through a distance of only R/2 in the case of a symmetrical dual movement circuit breaker, whereas the moving contact has moved through a distance R in the case of a single movement circuit breaker. Finally, the reduced moving contact speed in a dual movement device presents a significant advantage in terms of total kinetic energy, and energy consumption can be reduced by about 50% (in outline, the total moving mass is doubled but the mean speed of the contacts is halved and as a result total kinetic energy is approximately halved).

However, dual contact movement does not lead only to advantages, particularly if it is associated with a break chamber having low gas compression. Because of the reduced displacement of the contacts, the length L of the compression chamber (the relative stroke of the piston in the compression chamber) is halved, and as a result the blast pressure is likewise halved.

It should also be recalled that in most low gas compression circuit breakers the piston in the break chamber is generally held fixed inside the case during the first portion of circuit breaker opening. It is the compression chamber which is secured to the contact carrying the blast nozzle and which moves towards the piston in order to compress the gas (see above-mentioned patent FR 2 696 274). For a single movement circuit breaker, this gives a compression length L equal to the stroke of the moving contact during the first stage of opening, i.e. likewise equal to the overlap distance R of the contacts. By way of simplification, it is assumed that the compression volume Vc is equal to L×S where S is the section of the piston (the bore).

In comparison, in a dual contact movement circuit breaker the compression length L is equal to R/2. Thus, to obtain a compression volume Vc equivalent to that of a single movement circuit breaker without increasing the overlap distance R of the contacts, it is necessary to double the section S of the piston. That solution presents three kinds of drawback:

- it makes it necessary to increase the diameter of the case, and thus the overall size of the case;
- it makes it necessary to double the force required for compression purposes in order to obtain the same gas pressure; and
- it amounts practically to doubling the mass of the moving elements, thereby nullifying the saving in kinetic energy consumption that is achieved by using dual movement.

In order to increase compression volume without increasing piston section, certain single movement devices enable a compression length L to be obtained that is longer than the contact overlap distance R, typically to lie in the range 1.1 R to 1.25 R. To this end, the piston is no longer stationary during the compression stage, but is moved a little inside the case towards the compression chamber by means of a linkage connected to the piston and to the contact carrying the compression chamber. An example of such a system is to be found in European patent EP 0 664 552. The piston is then said to execute reciprocating movement since it moves in one direction during the compression stage and in the opposite direction after the contacts have separated. This movement during the first stage of movement is equal to the distance L−R and in known devices that represents only 10% to 20% of the length L of the compression volume.

When applied to a circuit breaker having dual contact movement, such a system with reciprocating piston movement can make it possible to obtain a compression length L that lies typically in the range 1.1 R/2 to 1.25 R/2 instead of having L equal to R/2 for a fixed piston. The blast pressure thus remains well below that obtained in an analogous single movement circuit breaker.

OBJECTS AND SUMMARY OF THE INVENTION

An object of the invention is to provide a solution which remedies those drawbacks, and capable of being applied to all types of circuit breaker having a break chamber with reduced gas compression, regardless of whether they use single or dual contact movement.

Specifically, the invention makes it possible in a circuit breaker having dual contact movement to combine the advantages of single contact movement circuit breakers with the advantages of dual movement circuit breakers while avoiding their drawbacks. In particular, the invention provides a device possessing the same compression length L as a single movement device for given contact overlap distance R. The invention also makes it possible to improve the performance of single contact movement circuit breakers. Devices known in the prior art can typically achieve values of L lying in the range R to 1.25 R. In comparison, a device proposed in the context of the present invention makes it possible to obtain L equal to 2 R at least.

To this end, the invention provides a gas blast switch possessing a break chamber with low gas compression, the switch comprising a first contact and a second contact, the first contact being movable along a longitudinal axis and being secured to the break chamber in which the gas is compressed by a piston, displacement means for displacing said piston being arranged so that its movement changes direction inside the case of the switch after the gas compression stage, wherein said displacement means comprise a telescopic link connected to said piston, and wherein the length of the displacement of said piston inside said case during said compression stage is not less than the length of the displacement of said first contact during said same compression stage.

In a first embodiment of the switch of the invention, said second contact is movable along said longitudinal axis in the opposite direction to said first contact.

In a particular embodiment of the switch of the invention, said piston is connected in alternation with the second contact and with the first contact during the operation of opening the switch.

In a particular embodiment of the switch of the invention, said piston is secured to the second moving contact by means of the telescopic link throughout the gas compression stage, and is separated therefrom after said first and second contacts have separated so as to become secured to said first contact. This form of connection makes it possible to obtain a compression length L equal to said distance R.

In a particular embodiment of the switch of the invention, the telescopic link is formed by a first cylinder extending the piston and surrounded by a second cylinder, the second cylinder being fixed to a peripheral link that is permanently secured to the moving second contact. Said telescopic link comprises a locking assembly that unlocks at the end of the gas compression stroke to allow the movement of the piston to change direction and to follow the movement of the first contact after the first and second contacts have separated.

In a particular embodiment of the switch of the invention, said locking assembly is constituted by balls disposed in openings formed in the first cylinder, said balls being engaged in internal peripheral grooves of the second cylinder during the gas compression stage in order to lock said telescopic link.

BRIEF DESCRIPTION OF THE DRAWINGS

The invention will be better understood on reading the following description given with reference to the accompanying drawings.

MORE DETAILED DESCRIPTION

Figure 1:
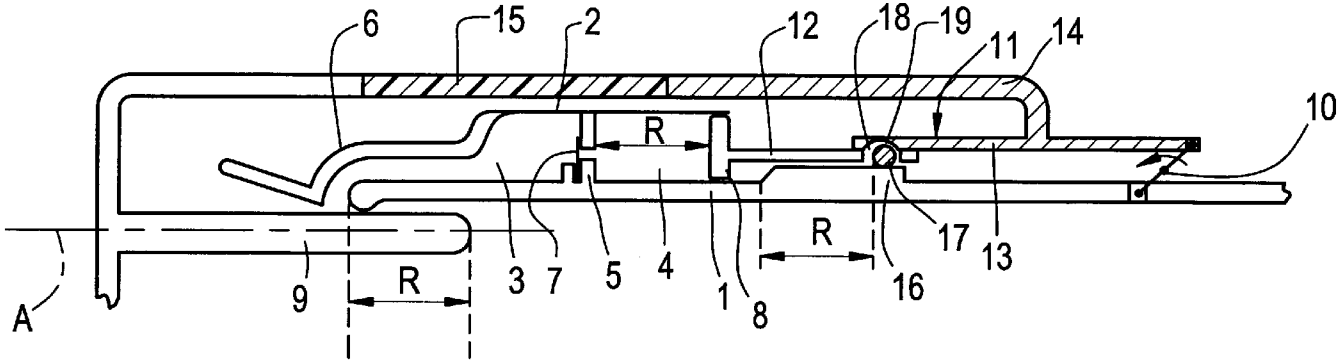
FIG. 1 is a highly diagrammatic axial half-section view of a circuit breaker of the invention in its closed position.

In the figures, a circuit breaker of the invention is shown in axial half-section relative to its axis A of circular symmetry. It comprises a generally cylindrical case (not shown in the figures) containing a first contact 1 which is hollow and movable in translation along the axis A with a cylindrical break chamber 2 surrounding the contact 1 coaxially. The break chamber 2 forms a blast volume 3 and a compression volume 4 that are separated by a yoke 5 coaxial with the contact 1, secured thereto, and projecting radially therefrom. The blast volume is closed by a nozzle 6 and communicates through the yoke 5 via a check valve 7 with the compression volume 4 which is in turn closed by a piston 8.

Inside its case, the circuit breaker further comprises a second contact 9 in the form of a rod which is inserted in the hollow contact 1 when the circuit breaker is in its closed position. The contact 9 is coaxial with the contact 1 and passes through the neck of the nozzle 6 when the circuit breaker is in its closed position, as shown in FIG. 1. Depending on the positioning of the drive mechanism (not shown in the figures), the contact 9 of the contact 1 is moved in translation along the axis A so as to be inserted in the other contact or separated therefrom.

The movement of the contact 9 is relayed in the opposite direction to the contact 1 by a pivoting mechanism secured to the inside of the circuit breaker case and represented at 10. This mechanism may be a rack-and-pinion system or it may comprise a linkage such that the two contacts always move in opposite directions along the axis A.

The piston 8 is constrained to move with the contact 9 specifically by means of a telescopic mechanical link 11 which extends along the axis A and which is formed by a first cylinder 12 extending the rear of the piston 8 and a second cylinder 13 that slides on the cylinder 12. A peripheral link 14 can be constituted by a third cylinder or by connecting rods disposed around the axis A to surround the second cylinder 13 and is secured thereto and also to the second contact 9 by conventional fixing means. This peripheral link 14 advantageously comprises a cylindrical segment of insulating material 15. Over a fraction of its length, the contact 1 carries a peripheral thickening 16 against which there bear balls 17 placed in openings 18 formed in the cylinder 12 and engaging in an inner peripheral groove 19 of the second cylinder 13 during the gas compression stage, i.e. at the beginning of opening.

In the closed position of the circuit breaker as shown in FIG. 1, the piston 8 is spaced apart from the yoke 5 at the end of the compression chamber remote from the piston, and the balls 17 bearing against the thickening 16 are engaged in the grooves 19 of the second cylinder 13. The telescopic link 11 is then locked in its deployed position.

Figure 4:
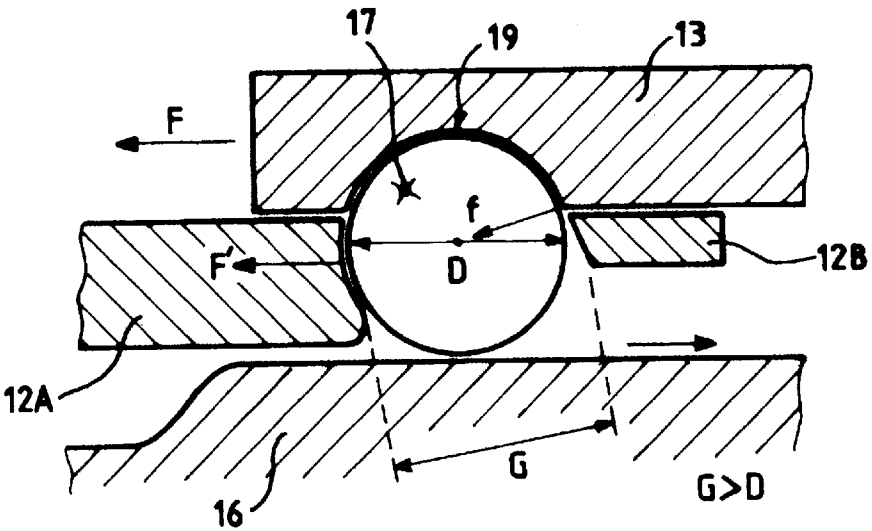
FIG. 4 is a highly diagrammatic axial half-section view of a locking assembly used in the device of the invention. The assembly is shown during the gas compression stage.

During a first portion of an opening operation, the contact 1 is moved in a certain direction along the axis A, in this case to the right, while the contact 9 is moved in the opposite direction along the axis A, in this case to the left as shown by the arrows. It can be observed that this mutual displacement of the contacts can also be provided by thrust from a drive mechanism (not shown in the figures) acting on the second cylinder 13. At this stage, the telescopic link 11 is locked by the balls 17 which transmit the thrust from the second cylinder 13 to the portion 12A of the first cylinder 12 which is extended by the piston 8. As a result, the piston 8 is moved in the opposite direction to the contact 1 and thus to the yoke 5 so that by moving towards each other, the yoke 5 and the piston 8 compress the gas in the compression volume 4. As shown in FIG. 4, it can be observed that the small annular portion 12B of the first cylinder 12 situated at the end of the cylinder remote from the piston is not subjected to any force coming from the balls, so clearance can exist between the balls and said small annular portion 12B. The portion 12A of the first cylinder 12 has housings level with the openings 18, each housing having a spherical surface portion complementary to the surface of the ball that bears against the housing, so as to keep down the contact pressure exerted by each of the balls on said portion 12A while compressing the gas. In order to limit the stresses to which the telescopic link 11 is subjected by the balls 17, the depth of the grooves 19 in the second cylinder 13 typically lies in the range 30% to 50% of the diameter D of the balls. The portion 12A of the first cylinder 12 can thus have thickness equal to up to 70% of the diameter D of the balls. There need only be a small gap between said portion 12A and the peripheral thickening 16 against which the balls 17 bear. As shown in FIG. 4, the clearance between the balls and the annular portion 12B enables the minimum diameter G of the opening 18 to be greater than the diameter D of the balls, even when the gap between the portion 12A of the first cylinder 12 and the peripheral thickening 16 is reduced to a minimum.

Figure 2:
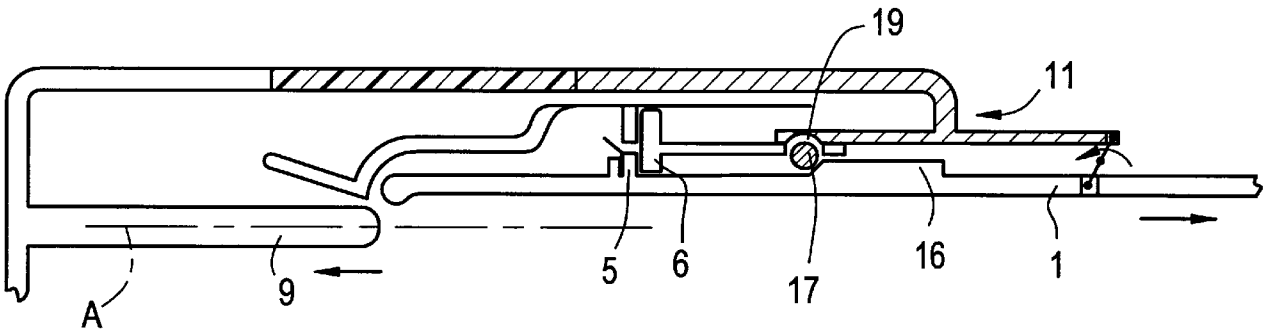
FIG. 2 is a highly diagrammatic axial half-section view of a circuit breaker of the invention in an intermediate position during opening.
Figure 6:
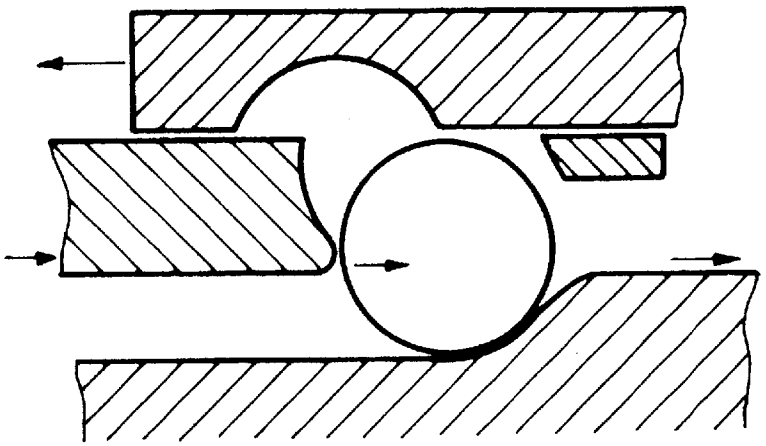
FIG. 6 shows said locking assembly immediately after the position described with reference to FIG. 5. This moment corresponds to piston movement reversing.
Figure 5:
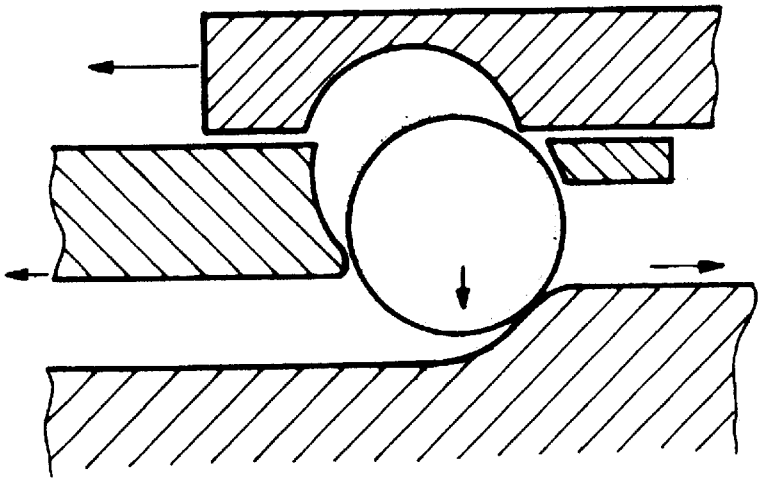
FIG. 5 shows said locking assembly at the end of gas compression, in a position corresponding to that described with reference to FIG. 2.

In FIG. 2, when the piston 8 comes into abutment against the yoke 5 at the end of the gas compression stroke, the balls 17 are located at one end of the thickening 16 and therefore escape from the groove 19 in order to unlock the telescopic link 11 which can then retract as shown in FIGS. 5 and 6. Thus, at the end of the gas compression stroke, the piston 8 is pushed by the yoke 5 and moves in the same direction as the contact 1, i.e. in the opposite direction to the contact 9.

Figure 3:
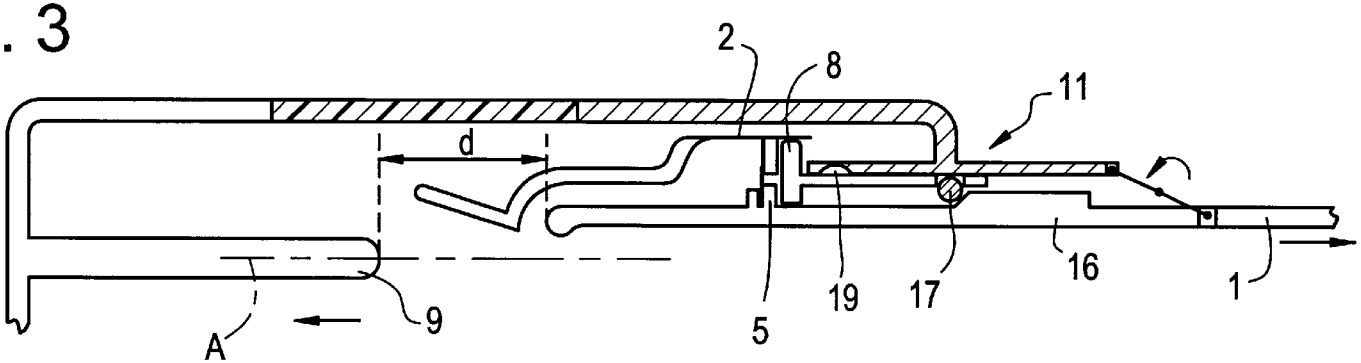
FIG. 3 is a highly diagrammatic axial half-section view of a circuit breaker of the invention in its open position.

In FIG. 3, the circuit breaker is at the end of its opening stroke and the isolation distance d between the two contacts 1 and 9 has been reached.

The length L of the compression volume 4 along the axis A is substantially equal to the length R of the overlap zone between the contacts, and also to the distance through which the balls 17 are moved over the thickening 16. The isolation distance d between the two contacts 1 and 9 is also substantially equal to the distance of the relative displacement of the second cylinder 13 relative to the cylinder 12 along the axis A.

Figure 7:
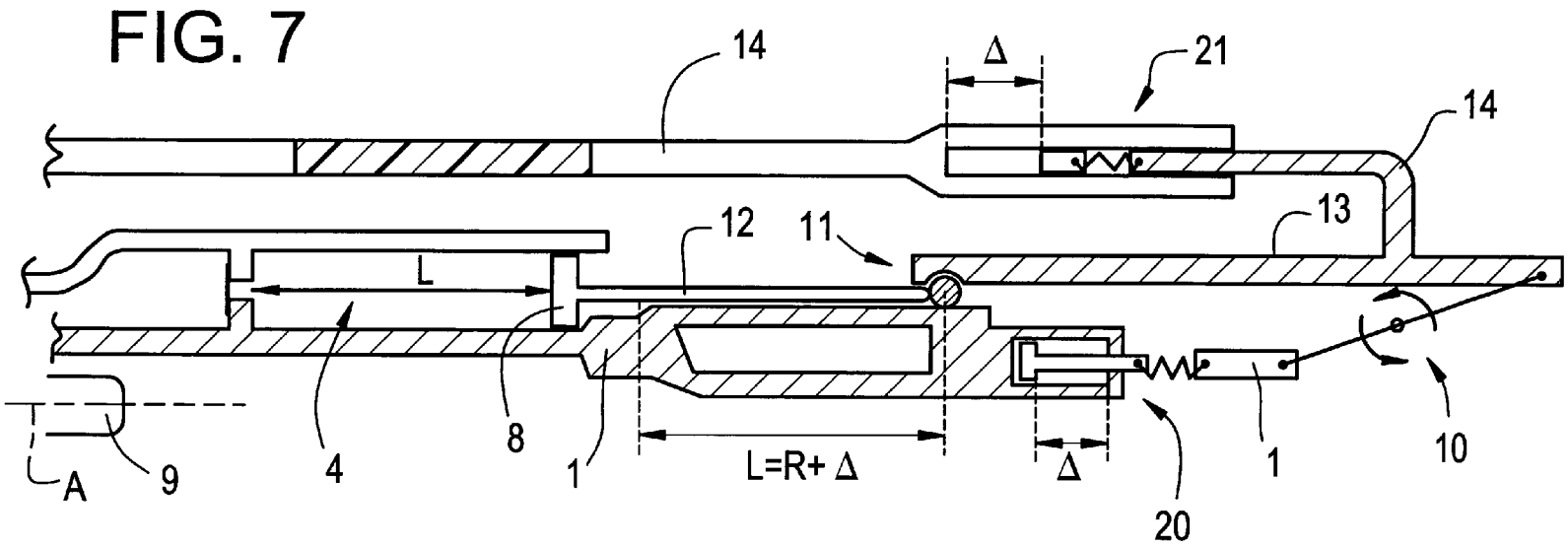
FIG. 7 is a highly diagrammatic axial half-section view of a particular embodiment of a circuit breaker of the invention. Telescopic inserts provide clearance Δ enabling the stroke L of the piston in the compression volume during the gas compression stage to be greater than the overlap distance R of the first and second contacts.

FIG. 7 shows a variant embodiment of the dual contact movement circuit breaker of the invention. A portion of the operation of compressing the gas in the compression volume takes place before the beginning of the stage in which the first and second contacts are set into motion, with the start of their motion being delayed relative to triggering of switch opening so as to give the piston time to have traveled a distance Δ when contact motion is triggered. The delay in the displacement of the first and second contacts is obtained by two telescopic insert systems 20 and 21 which separate the first contact 1 and the peripheral link 14 respectively into two portions each along the axial direction A. Each insert system thus makes it possible to accommodate a certain amount of longitudinal relative movement between the two portions of the same element that are separated thereby. To understand this principle, FIG. 7 is shown with clearance Δ constituted by a gas space, but other variants could be envisaged. For example, each of the inserts 20 and 21 could be constituted by a spring interconnecting the two portions that it separates. Systems for locking the first and second contacts then need to be provided in such a manner as to hold these contacts stationary so long as the displacement of the piston 8 in the volume 4 has not reached the desired length Δ. A linkage, e.g. from the cylinders 12 or 13 of the telescopic link 11, can unlock these locking systems once the length Δ is reached, with the springs then being compressed so as to enable the first and second contacts to be put into motion with a large amount of acceleration.

This device makes it possible to increase the compression volume to the detriment of the contact separation time which increases, and also to the detriment of the mass of the moving elements. For equivalent compression volume, it is possible to diminish the overlap distance R between the first and second contacts by increasing Δ.

Figure 9:
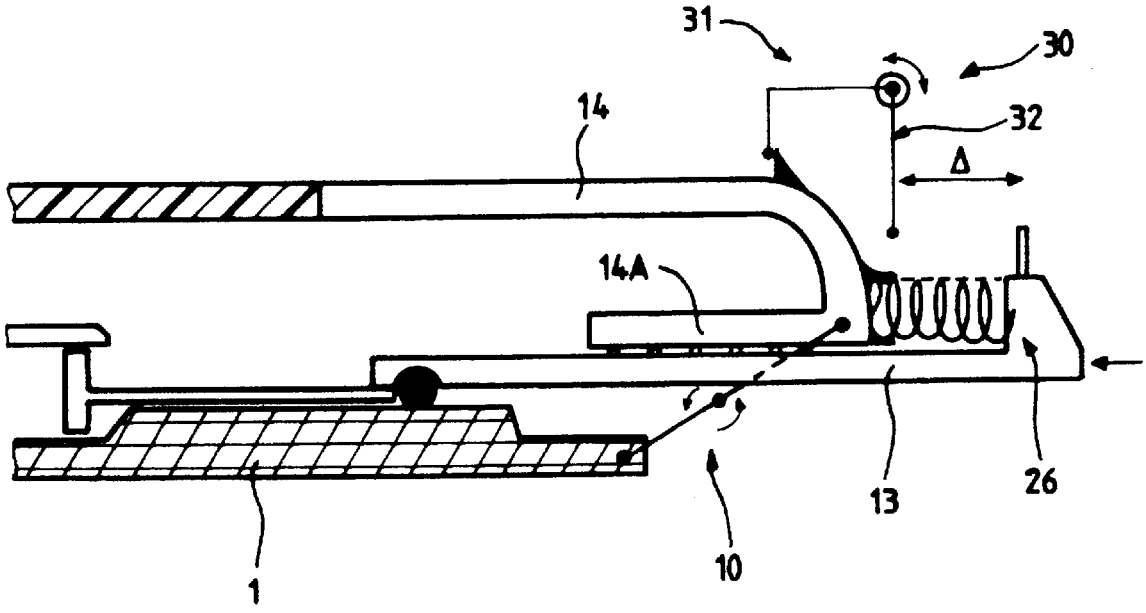
FIG. 9 is a highly diagrammatic axial half-section view of a system of spring inserts introducing clearance Δ enabling a result to be achieved that is equivalent to that obtained by the device described with reference to FIG. 7.

In FIG. 9, the delay in displacing the first and second contacts is achieved by means constituted by a single telescopic insert system such as springs 26 that make it possible to impart a certain amount of longitudinal relative motion between the second cylinder 13 and the peripheral link 14. The peripheral link can be extended by a cylindrical portion 14A surrounding the second cylinder 13 and capable of sliding along it, e.g. by ball bearings. The pivot mechanism 10 enabling the movements of the first and second contacts to be coordinated passes through the second cylinder 13 via longitudinal openings provided for this purpose. In this device, the circuit breaker drive mechanism (not shown) is connected to the second cylinder 13 and acts by applying thrust in the direction of the arrow in the figure while opening the circuit breaker. The system for locking the first and second contacts can be implemented in this case by a single device 30, e.g. constituted by a lockable pivoting arm 31 holding the peripheral link 14 by means of a stud, said arm being capable of being unlocked in conventional manner by the second cylinder 13 bearing against an element 32 which controls movement of said arm, once said second cylinder has traveled a distance Δ.

Figure 8:
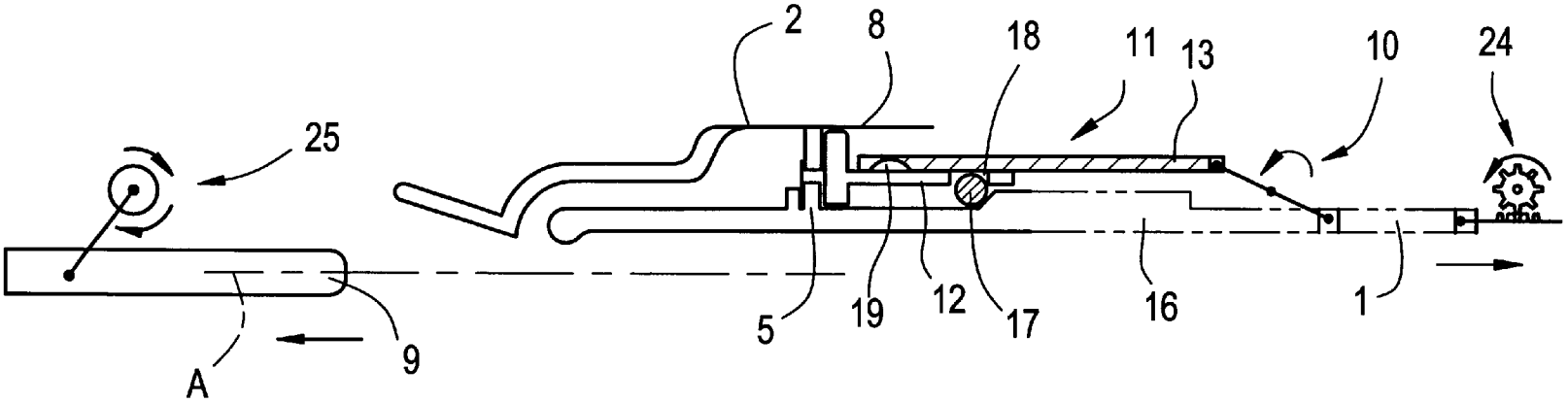
FIG. 8 is a highly diagrammatic axial half-section view of a circuit breaker of the invention possessing second contact drive means that are separate from those of the first contact.

FIG. 8 shows a circuit breaker whose component means are equivalent to those of the circuit breaker described with reference to FIGS. 1 and 3, except that the means 25 for driving the second contact are separate from the means 24 for driving the first contact. In the device shown, the stroke L of the piston 8 during the gas compression stage is equal to the overlap distance R between the first and second contacts. It is also possible to obtain a compression length L that is greater than R by splitting the first contact into two portions by means of a telescopic insert system 20 of the kind shown in FIG. 7. The drive means 25 are then actuated with a certain amount of delay compared with the means 24, as a function of the stroke Δ provided by the said insert system, so as to synchronize the displacements of the first and second contacts.

Finally, it is also possible to make a circuit breaker that possess single contact movement, and such that the stroke L of said piston in the compression volume during the gas compression stage is equal to not less than twice the overlap distance R between the moving contact and the fixed contact. Compared with the dual contact movement device described with reference to FIG. 8, the drive means 25 can be omitted so as to make the second contact fixed. Thus, the contacts separate when the first contact is moved through a distance equal to the overlap distance R, i.e. when the piston has moved through a distance R. The displacement of the piston 8 relative to the yoke 5 in the compression volume, i.e. the compression length L is then equal to twice the overlap distance R, or to even more than 2 R if the contact 1 is subdivided into two portions by a telescopic insert system 20 as shown in FIG. 7. In comparison, and as mentioned in the introduction, the devices known in the prior art make it possible to achieve a length L that lies typically in the range R to 1.25 R.

What is claimed is:

1. A gas blast switch possessing a case and a break chamber with low gas compression, the switch comprising a first contact and a second contact, the first contact being movable along a longitudinal axis and being secured to the break chamber in which the gas is compressed by a piston, displacement means for displacing said piston being arranged so that its movement changes direction inside the case of the switch after the gas compression stage, wherein said displacement means comprise a telescopic link connected to said piston, and wherein the length of the displacement of said piston inside said case during said compression stage is not less than the length of the displacement of said first contact during said same compression stage.

2. The switch of claim 1, in which said second contact is movable along said longitudinal axis in the opposite direction to said first contact.

3. The switch of claim 2, in which said piston is connected in alternation with the second contact and with the first contact during the operation of opening the switch.

4. The switch of claim 3, in which said piston is secured to the second moving contact by means of the telescopic link throughout the gas compression stage, and is separated therefrom after said first and second contacts have separated so as to become secured to said first contact.

5. The switch of claim 1, in which the telescopic link is formed by a first cylinder extending the piston and surrounded by a second cylinder, the second cylinder being fixed to a peripheral link that is permanently secured to the moving second contact, said telescopic link comprising a locking assembly that unlocks at the end of the gas compression stroke to allow the movement of the piston to change direction and to follow the movement of the first contact after the first and second contacts have separated.

6. The switch of claim 5, in which said locking assembly is constituted by balls disposed in openings formed in the first cylinder, said balls being engaged in internal peripheral grooves of the second cylinder during the gas compression stage in order to lock said telescopic link.

7. The switch of claim 6, in which the depth of said peripheral grooves lies in the range 30% to 50% of the diameter D of the balls.

8. The switch of claim 5, in which the cylindrical portion of the first cylinder has housings level with the openings, each housing presenting a spherical surface portion complementary to the surface of the ball bearing against said housing so as to limit the contact pressure exerted by the balls against said portion during gas compression.

9. The switch of claim 1, in which a portion of the operation of compressing the gas in the compression volume takes place before the stage in which the first contact is set into motion, with this being delayed relative to opening of the circuit breaker being triggered in order to allow the piston already to have traveled a certain distance when the movement of the first contact is engaged.

10. The switch of claim 5, in which a portion of the operation of compressing the gas in the compression volume takes place before the stage in which the first contact is set into motion, with this being delayed relative to opening of the circuit breaker being triggered in order to allow the piston already to have traveled a certain distance when the movement of the first contact is engaged, and in which the delay before said opening stage begins is obtained by means consisting in two telescopic insert systems respectively subdividing the first contact and the peripheral link so that each of them forms two portions along the longitudinal axis, each insert system enabling a certain amount of relative movement to take place longitudinally between the two portions of the element it subdivides.

11. The switch of claim 5, in which a portion of the operation of compressing the gas in the compression volume takes place before the stage in which the first contact is set into motion, with this being delayed relative to opening of the circuit breaker being triggered in order to allow the piston already to have traveled a certain distance when the movement of the first contact is engaged, and in which the delay in the beginning of said opening stage is obtained by means consisting in a telescopic insert system accommodate a certain amount of longitudinal relative movement between the second cylinder and the peripheral link.

12. The switch of claim 1, in which said second contact is fixed in said case and in which a stroke L of said piston in the compression volume during the gas compression stage is not less than twice the overlap distance R of the moving contact and the fixed contact.

13. The switch of claim 5, in which the first contact is connected to the second cylinder of the telescopic link by a pivoting lever mechanism enabling said first contact and second cylinder to move at the same speed in opposite directions.

14. A gas blast switch possessing a case and a break chamber with low gas compression, the switch comprising a first contact and a second contact, the first contact being movable along a longitudinal axis and being secured to the break chamber in which the gas is compressed by a piston, a telescopic link connected to said piston so that the piston's movement changes direction inside the case of the switch after the gas compression stage, wherein the length of the displacement of said piston inside said case during said compression stage is not less than the length of the displacement of said first contact during said same compression stage.

* * * * *